US011381044B2

(12) United States Patent
Bednarz et al.

(10) Patent No.: US 11,381,044 B2
(45) Date of Patent: Jul. 5, 2022

(54) BLIND MATE CONNECTOR BLOCK AND SYSTEMS AND METHODS THEREOF

(71) Applicant: LOCKHEED MARTIN CORPORATION, Bethesda, MD (US)

(72) Inventors: Anthony Jonathan Bednarz, Moorestown, NJ (US); Marc T. Angelucci, Moorestown, NJ (US); Ilya Gershkovich, Moorestown, NJ (US); Mohsin Peeran, Akron, PA (US); Robert C. Hosler, Elizabethtown, PA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 90 days.

(21) Appl. No.: 16/935,371

(22) Filed: Jul. 22, 2020

(65) Prior Publication Data

US 2022/0029363 A1 Jan. 27, 2022

(51) Int. Cl.

| | |
|---|---|
| ***H01R 24/52*** | (2011.01) |
| ***H01R 13/193*** | (2006.01) |
| ***H01R 103/00*** | (2006.01) |

(52) U.S. Cl.

CPC ..... *H01R 24/52* (2013.01); *H01R 13/193* (2013.01); *H01R 2103/00* (2013.01); *H01R 2201/20* (2013.01); *H01R 2201/24* (2013.01)

(58) Field of Classification Search

CPC .. H01R 13/193; H01R 24/52; H01R 2103/00; H01R 2201/20; H01R 2201/24;

(Continued)

(56) References Cited

U.S. PATENT DOCUMENTS 5,329,262 A * 7/1994 Fisher, Jr. ..... H01R 13/6315 333/260

6,409,550 B1 6/2002 Splichal et al.

(Continued)

FOREIGN PATENT DOCUMENTS

CN 106654760 A 5/2017

OTHER PUBLICATIONS

"Microwave Gilbert® Push-on Interconnects", Corning Optical Communications, Microwave Catalog, https://www.corning.com, CRR-721-AEN. Jul. 11, 2019, pp. 69-100.

(Continued)

*Primary Examiner* — Oscar C Jimenez
*Assistant Examiner* — Paul D Baillargeon
(74) *Attorney, Agent, or Firm* — Michael Best & Friedrich LLP

(57) ABSTRACT

A connector block comprised of a plurality of spring-embedded blind mate connector assemblies. Each of the spring-embedded blind mate connector assemblies can be comprised of a first connector extending in a first direction and a second connector extending in a second direction opposite the first direction, where the first connector and the second connector can have a common axis and can be operatively coupled to pass a signal between opposite ends of the spring-embedded blind mate connector assembly. The first connector can include a captivator, a connection extension, and a spring between the captivator and the second connector, where the spring can abut the captivator and have an outer diameter no greater than an outer diameter of the captivator.

18 Claims, 7 Drawing Sheets

(58) Field of Classification Search
CPC ..... H01R 12/716; H01R 24/44; H01R 24/50; H01R 12/722; H01R 12/727; H01R 12/91
See application file for complete search history.

(56) References Cited

U.S. PATENT DOCUMENTS

| | | | | |
|---|---|---|---|---|
| 2006/0051997 | A1* | 3/2006 | Kooiman ..... | H01R 13/743 439/180 |
| 2007/0111596 | A1 | 5/2007 | Weidner et al. | |
| 2019/0221975 | A1 | 7/2019 | Barany et al. | |

OTHER PUBLICATIONS

International Search Report and Written Opinion for Application No. PCT/US2020/064029 dated Mar. 23, 2021 (15 pages).

* cited by examiner

BLIND MATE CONNECTOR BLOCK AND SYSTEMS AND METHODS THEREOF

SUMMARY

Embodiments of the disclosed subject matter are directed to connectors, particularly blind mate connectors.

Embodiments of the disclosed subject matter can involve or provide a spring-embedded blind mate connector assembly. The spring-embedded blind mate connector assembly can comprise a first connector extending in a first direction; and a second connector extending in a second direction opposite the first direction. The first connector and the second connector can have a common axis, and the first connector and the second connector can be operatively coupled to pass a signal between opposite ends of the spring-embedded blind mate connector assembly. The first connector can include: a captivator, a connection extension, and a spring between the captivator and the second connector, the spring abutting the captivator and having an outer diameter no greater than an outer diameter of the captivator.

According to one or more embodiments of the disclosed subject matter, a blind mate connection system can be provided or implemented. The blind mate connection system can comprise a first blind mate connector block configured to interface with an upper surface of a printed circuit board (PCB); and a second blind mate connector block configured to interface with a lower surface of the PCB opposite the upper surface of the PCB. Respective bottoms of the first and second blind mate connector blocks can face each other when the first and second blind mate connector blocks interface with the upper and lower surfaces of the PCB, respectively. Each of the first and second blind mate connector blocks can include: a mounting base, a first connector arm extending from the mounting base in a first direction, the first direction being in a length-wise direction of the blind mate connector block, and a second connector arm extending from the mounting base in a second direction opposite the first direction, the second direction being in the length-wise direction of the blind mate connector block. The first connector arm may include a first set of connector assemblies, the second connector arm may include a second set of connector assemblies, and/or the first and second sets of connector assemblies may be aligned with each other in the length-wise direction of the blind mate connector block.

Additionally, one or more embodiments of the disclosed subject matter can provide or implement a spring-embedded blind mate connector block for a radar system. The spring-embedded blind mate connector block can comprise a mounting base having a bottom mounting surface configured to be mounted to an upper surface of a mounting structure associated with a printed circuit board (PCB); a first radio frequency (RF) connector arm integral with the mounting base and extending from the mounting base in a first direction, the first direction being in a length-wise direction of the spring-embedded blind mate connector block; and a second radio frequency (RF) connector arm integral with the mounting base and extending from the mounting base in a second direction opposite the first direction, the second direction being in the length-wise direction of the spring-embedded blind mate connector block. The first RF connector arm may include a first set of RF connector assemblies, the second RF connector arm may include a second set of RF connector assemblies, and/or the first and second sets of RF connector assemblies may be aligned with each other in the length-wise direction of the spring-embedded blind mate connector block. Each of the RF connector assemblies can include: a first RF connector extending from a first side of the spring-embedded blind mate connector block, the first RF connector being a male-to-female RF connector, and a second RF connector at a second side of the spring-embedded blind mate connector block opposite the first side, the second RF connector being a male-to-PCB edge launch connector. The first RF connector and the second RF connector may be aligned with each other in a width-wise direction of the spring-embedded blind mate connector block. Each of the first RF connectors can include a captivator, a connection extension having a first end coupled to the captivator and a second end provided in a channel formed inside the spring-embedded blind mate connector block, and a spring circumscribing the connection extension and embedded between the captivator and the first side of the spring-embedded blind mate connector block. The spring may be in abutting relationship with the captivator and the first side of the spring-embedded blind mate connector block and/or may have a diameter no greater than a diameter of the captivator.

Embodiments can also include methods of providing, making, and/or using apparatuses, assemblies, and systems, or portions thereof, according to one or more embodiments of the disclosed subject matter.

The preceding summary is to provide an understanding of some aspects of the disclosure. As will be appreciated, other embodiments of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
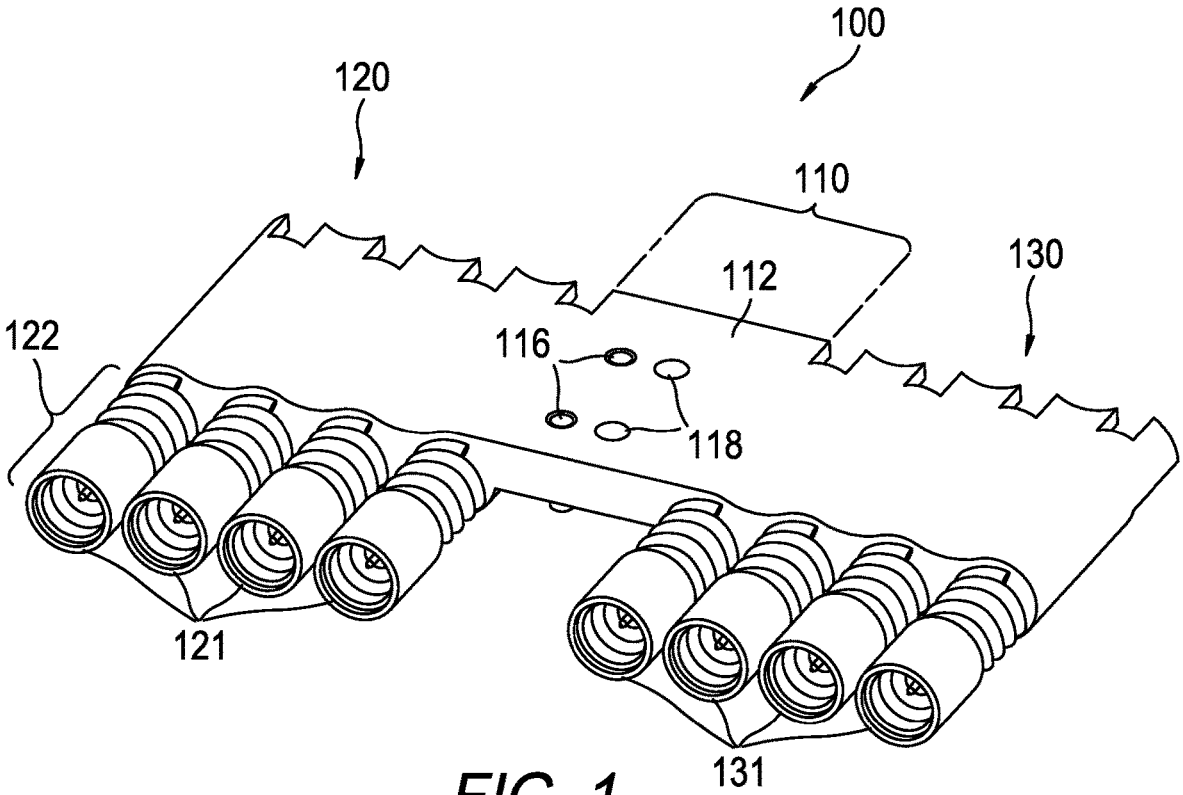
FIG. 1 is a top, front perspective view of a connector block according to one or more embodiments of the disclosed subject matter.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more" or "at least one." The phrases "at least one," "one or more," "or," and "and/or" are open-ended expressions that can be both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" can mean A alone, B alone, C alone, A and B together, A and C together, B and C together, or A, B and C together. It is also to be noted that the terms "comprising," "including," and "having" can be used interchangeably.

It is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Radio-frequency (RF) connectors can be utilized in a range of applications, including radar-related systems or components, as but one example. Reliable RF connections in the context of so-called blind mate radar systems or components may be challenging due to relatively tight lattice spacing and space-constrained packaging requirements (e.g., 96 connectors in a 3" by 0.5" envelope) and connector pitch potentially precluding certain spring-based solutions. For example, dual pole differential elements (e.g., up to 48 GHz) can enhance system performance, but can require four connectors per element. And blind mate applications can have inherent tolerance buildup between adjoining components, but should still be capable of reliably mating across expected conditions (i.e., maintaining float).

As noted above, embodiments of the disclosed subject matter are directed to connectors, particularly blind mate connectors. In general, a blind mate connector can be described as a connector that implements a mating action via a sliding or snapping action, and that may have self-aligning features to allow for relatively small misalignment when mating.

Generally speaking, embodiments of the disclosed subject matter can involve multiple connectors (e.g., RF connectors) adjoined as a single connector block with one set of mounting accommodations. Such single connector block may provide for a sharing of the structural load across the connectors, a sharing of alignment features, and/or a sharing of mounting features. Springs may be embedded in the connectors to provide a spring with a decreased diameter, which allows axial misalignment between both connectors but still provides sufficient clearance to one or more neighboring connectors. Turning to the figures, FIGS. 1-7 show various views of a connector block 100 according to one or more embodiments of the disclosed subject matter.

The connector block 100 can have a body that defines a base or central flange 110, a first connector extension or arm 120, and a second connector extension or arm 130. As shown in the figures, the first connection arm 120 can extend from the base 110 in a first direction, and the second connection arm 130 can extend from the base 110 in a second direction opposite the first direction. The first and second directions can be in a length-wise direction of the connector block 100. Thus, according to embodiments of the disclosed subject matter, the connector block 100 can have a length greater than a width. Optionally, the first connector arm 120 and/or the second connector arm 130 can be integral or formed in one piece with the base 110. According to one or more embodiments, the connector block 100 can be comprised of a top half and a bottom half fixedly coupled together to form the connector block 100.

Figure 4:
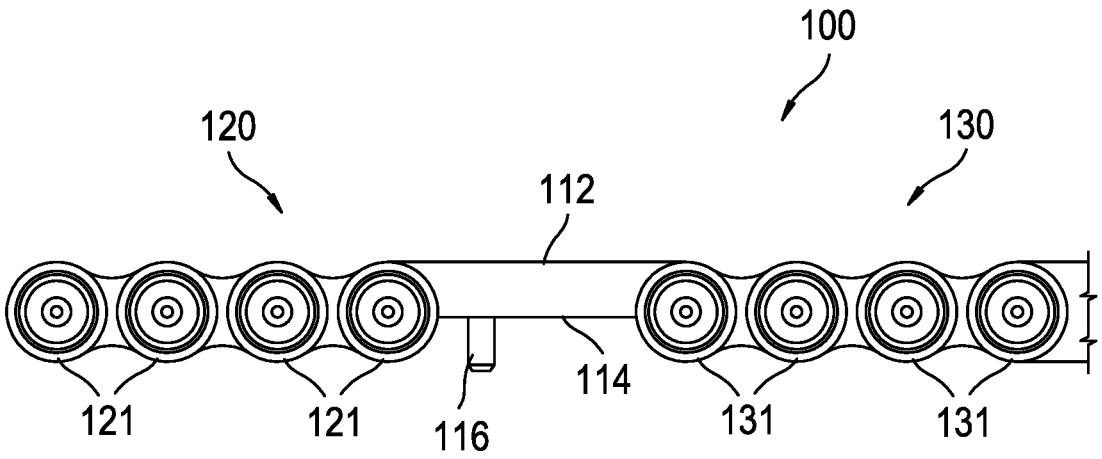
FIG. 4 is a front elevational schematic view of the connector block of FIG. 1.

As shown in FIG. 1 and FIG. 4, the base 110 can have an upper surface 112 and a lower surface 114. Discussed in more detail below, the lower surface 114 can be configured as a mounting surface to mount or couple the base 110 to an upper surface of a mounting structure associated with a printed circuit board (PCB), such as a spacer or mounting block. According to one or more embodiments, the upper surface 112 of the base 110 may form an upper-most surface of the connector block 100.

One or more rods or pins 116 (FIGS. 1-7 show two pins 116) can extend from the lower surface 114 of the base 110. As shown in FIGS. 4-7, the pins 116 can extend below lower-most portions of each of the first connector arm 120 and the second connector arm 130. Optionally, the pins 116 can be integral or formed in one piece with the base 110. Alternatively, the pins 116 may be extended through corresponding holes in the base 110. The pins 116 can be used to mount the connector block 100. Additionally or alternatively, the pins 116 can be used to align or orient the connector block 100, for instance, based on the asymmetrical nature in which the pins 116 can be provided on the base 110. As shown in FIG. 1, for instance, the pins 116 can be closer to the first connector arm 120 than to the second connector arm 130. Thus, according to one or more embodiments, the pins 116 can be dual-function or dual-purpose pins 116, to mount and align the connector block 100. The pins 116 optionally may be so-called shear pins.

Optionally, a plurality of through holes 118 may be provided in the base 110. According to one or more embodiments, the through holes 118 can be provided in a central width-wise axis of the connector block 100 (and of the base 110, see assembly of FIG. 9). Such through holes 118 may be to solder opposite side connector pins, for instance.

The first connector arm 120 can have a plurality of connector assemblies 121, which may be referred to herein as a first set of connector assemblies 121. Likewise, the second connector arm 130 can have a plurality of connector assemblies 131, which may be referred to herein as a second set of connector assemblies 131.

Optionally, the first and second sets of connector assemblies 121, 131 can be a same number and/or of a same configuration per first or second connector arm 120, 130. For instance, FIGS. 1-7 show each of the first connector arm 120 and the second connector arm 130 each having four connector assemblies 121, 131. Though embodiments of the disclosed subject matter may have only four (i.e., consists of four) connector assemblies 121, 131 per first and second connector arms 120, 130, embodiments of the disclosed subject matter are not so limited and can include more than four connector assemblies 121, 131 per first or second connector arm 120, 130 or less than four connector assemblies 121, 131 per first or second connector arm 120, 130.

Figure 2:
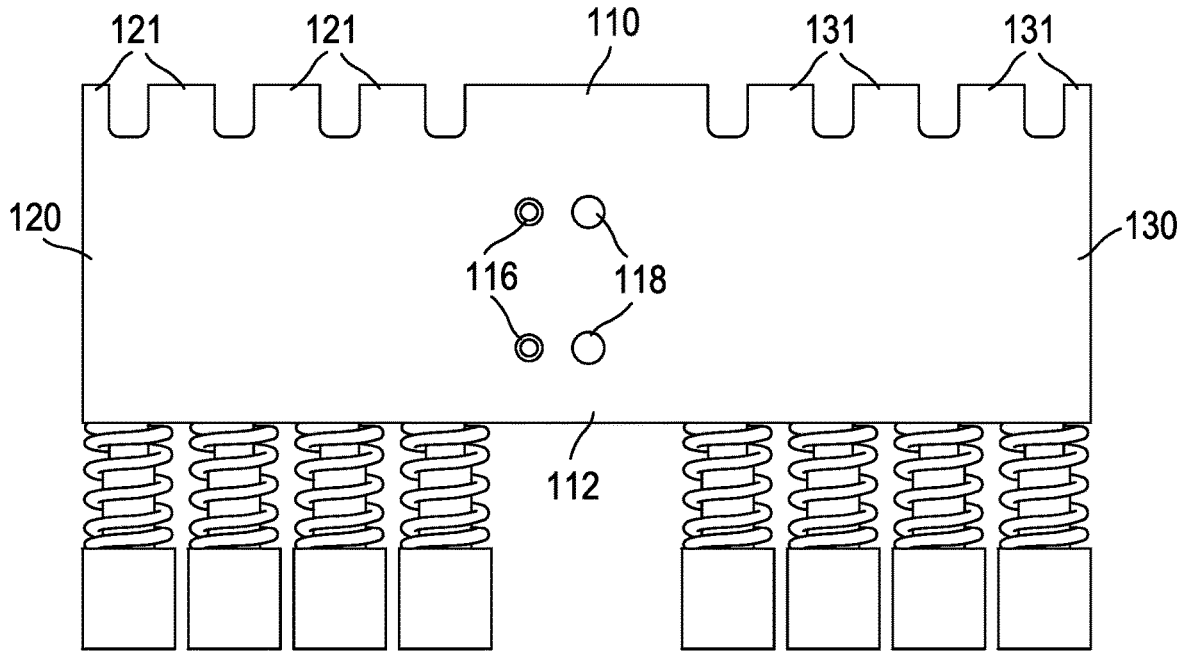
FIG. 2 is a top plan view of the connector block of FIG. 1.
Figure 3:
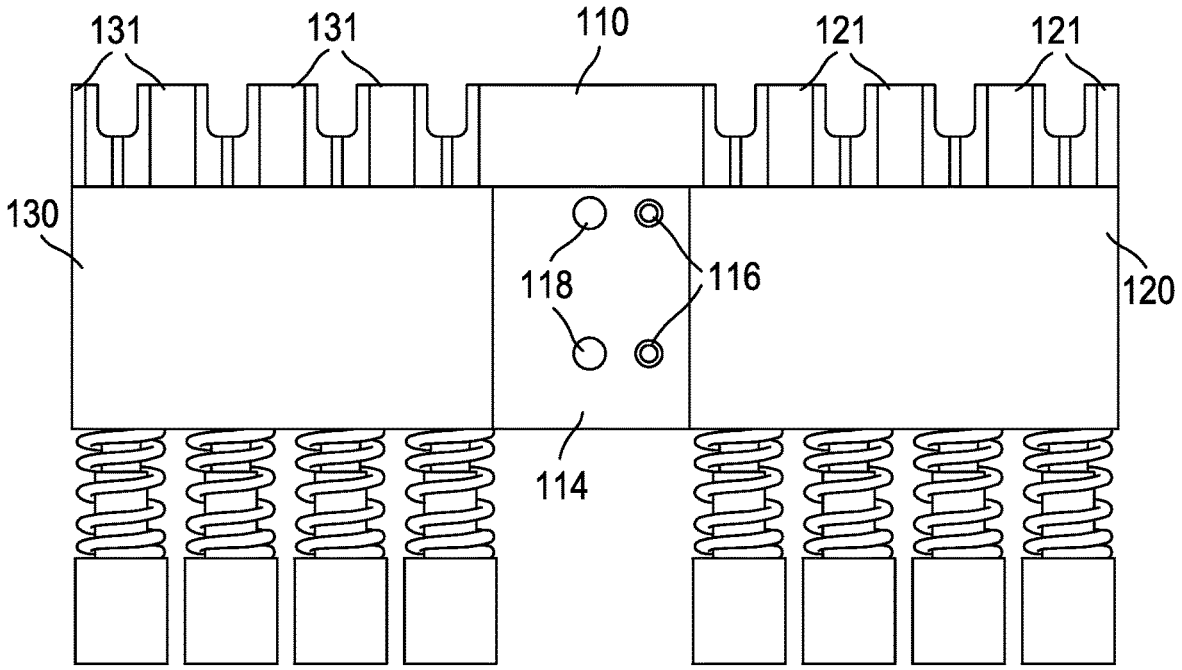
FIG. 3 is a bottom plan view of the connector block of FIG. 1.
Figure 5:
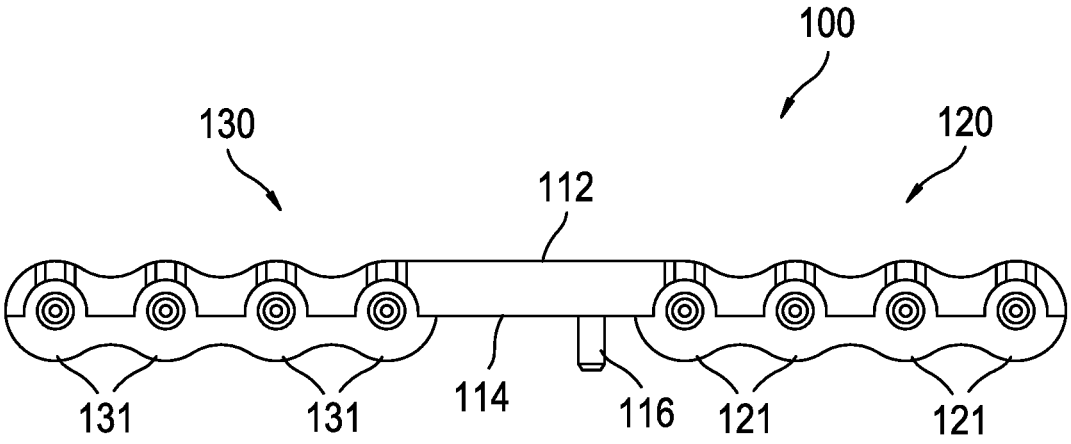
FIG. 5 is a rear elevational schematic view of the connector block of FIG. 1.
Figure 6:
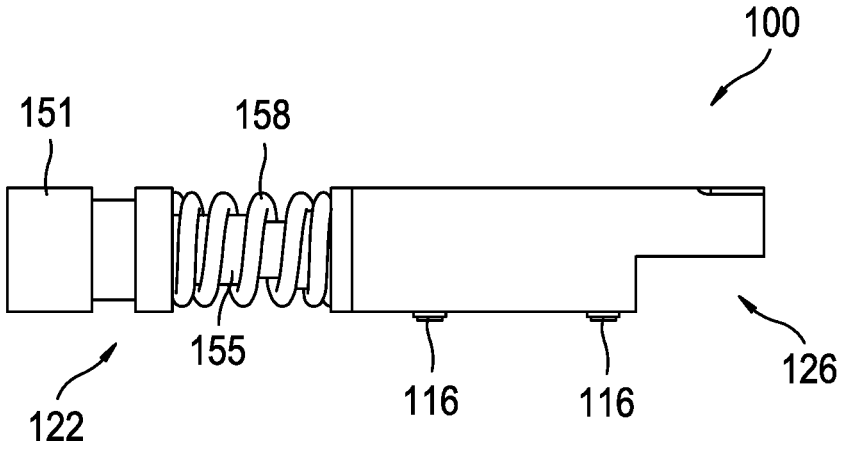
FIG. 6 is a side elevational view of the connector block of FIG. 1.
Figure 7:
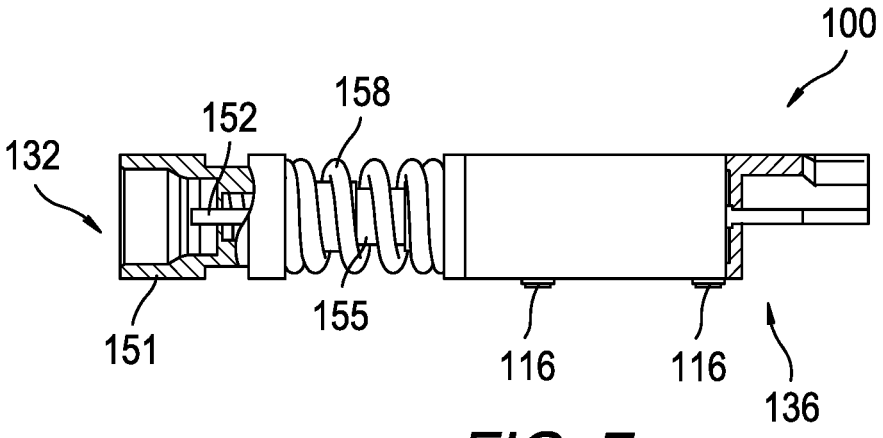
FIG. 7 is a side elevational partial cut-away view of the connector block of FIG. 1.

The connector assemblies 121 of the first connector arm 120 can be aligned with each other in the length-wise direction of the first connector arm 120. Likewise, the connector assemblies 131 of the second connector arm 130 can be aligned with each other in the length-wise direction of the second connector arm 130, and the connector assemblies 121 can be aligned with the connector assemblies 131 in the length-wise direction of the connector block 100. Such alignment can be in terms of front and end views of the connector block 100, such as shown in FIGS. 1, 4, and 5, in terms of top and bottom plan views, such as shown in FIGS. 2 and 3, and in terms of side views, such as shown in FIGS. 6 and 7.

Each of the connector assemblies 121 can include a pair of opposing connectors, a first connector 132 and a second connector 136. Likewise, each of the connector assemblies 131 can include a pair of opposing connectors, a first connector 132 and a second connector 136. According to one or more embodiments, the first and second connector arms 120, 130 can form part of the connector assemblies 121, 131, for instance, as housings to house or otherwise support respective portions of the first connectors 122, 132 and respective portions of the second connectors 126, 136. Optionally, portions of the first or second connector arms 120, 130 may be considered part of the pairs of opposing connectors.

Generally, the first connectors 122 can be provided on a front side of the connector block 100 and the second connectors 126 can be provided on a rear side of the connector block 100. The first connectors 122 can extend from the front side of the connector block 100. As shown in FIGS. 2, 3, and 6 the first and second connectors 122, 126 can be aligned in the thickness direction of the connector block 100. Likewise, the first and second connector blocks 120 and 130 can be aligned in the width direction of the connector block 100. The first connectors 122 can also be axially aligned with respective second connectors 126 thus sharing a common longitudinal axis.

According to one or more embodiments of the disclosed subject matter, each of the first connectors 122 can be a male-to-female connector, for instance, a male-to-female RF connector. Optionally, the first connectors 122 can be nano-miniature connectors, such as WSW®, G3PO™ or G4PO™ connectors. Additionally, according to one or more embodiments, each of the second connectors 126 can be an edge launch connector, such as a male-to-PCB edge launch connector.

Figure 8:
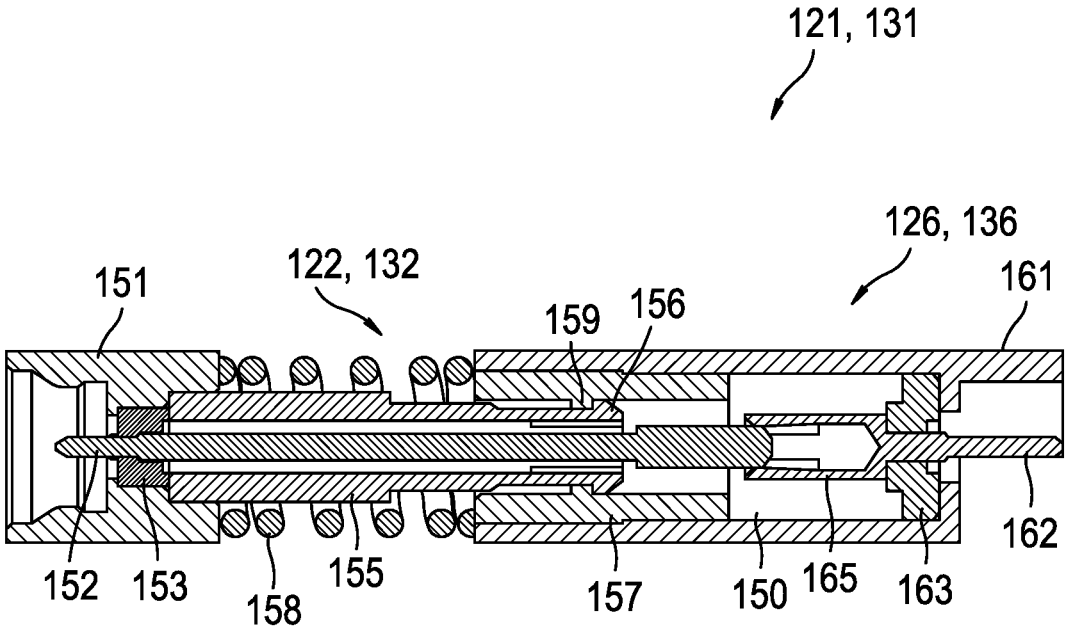
FIG. 8 is a sectional view of a portion of a connector block according to one or more embodiments of the disclosed subject matter.

Referring now to FIGS. 6-8, each of the first connectors 122 can have a captivator 151, a connection extension 155, and a spring 158.

The captivator 151 can have a free end configured to interface with another connector, such as a female RF connector, and an opposite end coupled to a first end of the connection extension 155. As shown in FIG. 8, a portion of the connection extension 155 can be inside of a channel or bore 150 formed by or in the first connector arm 120 or the second connector arm 130, depending upon the location of the first connector 122, 132. According to one or more embodiments, the captivator 151 can be generally cylindrical (circular in an end view), with a constant outer diameter as shown in FIGS. 1-8, for instance.

The spring 158 can be provided between the captivator 151 and the second connector 126, 136. For example, the spring 158 can abut the opposite end of the captivator 151 and the front side of the connector block 100 (or corresponding first or second connection arm 120, 130), such as shown in FIGS. 6-8. Additionally, according to embodiments of the disclosed subject matter, the spring 158 can be provided around, for instance, circumscribe, a portion of the connection extension 155 provided outside of the channel 150. Moreover, the spring 158 can be embedded between the captivator 151 and the front side of the connector block 100 (or corresponding first or second connection arm 120, 130) such that the spring 158 does not extend outside of a maximum outer profile of the captivator 151 or a maximum outer profile of the front side of the connector block 100 (or corresponding first or second connection arm 120, 130). For instance, an outer diameter of the spring 158 may be no greater (i.e., the same as or less than) an outer diameter of the captivator 151, such as particularly shown in FIGS. 4-8 (note that in FIGS. 4 and 5 the spring 158 is not visible because the outer diameter thereof is not greater than the outer diameter of the captivator 151). According to a non-limiting example, the spring 158 can provide for +/−0.020 axial travel. Also according to a non-limiting example, the spring 158, according to one or more embodiments, can have a K value of 36 lb/in. and/or compression of 40 thousandth of an inch.

Each first connector 122, 132 can also have a conductor pin 152, which can be a male conductor pin, and which can extend along the longitudinal axis of the first connector assembly 121 or the second connector assembly 131, from the captivator 151 toward and optionally to the second connector 126, 136, such as shown in FIG. 8. As shown, the conductor pin 152 can be radially surrounded by the captivator 151, the connection extension 155, which may be referred to as an outer sheath for the conductor pin 152, and the first or second connection arm 120, 130. Optionally, a conductor pin shield 153, which may be made of polytetrafluoroethene (PTFE), can be provided around the conductor pin 152, such as shown in FIG. 8. According to one or more embodiments, a retainer shroud 157 may be provided in the channel 150.

Each second connector 126 can have a connection interface 161, which may be in the form of a ledge and which may be viewed as extending from or forming a rear side of the connector block 100 (or the first or second connector arm 120, 130), a conductor pin 162, which may be a male conductor pin, and a sheath or terminal 165, which may be a female terminal. Thus, the connection interface 161 can be formed by the connector block 100, particularly the first or second connector arm 120, 130, to interface with a component, such as a top surface of a PCB, to electrically connect the conductor pin 162 to the PCB. According to one or more embodiments, the connection interface 161 in the form of a ledge can include a cutout at a free end thereof. Optionally, an insulating retainer 163, which can be made of a dielectric material (e.g., polytetrafluoroethene (PTFE) or a polyamide-imide), can be provided in the channel 150, around the conductor pin 162, for instance.

The captivator 151 can be configured to mechanically and electrically connect (e.g., removably connect) to another connector, such as a female bullet-type connector, as mentioned above. According to embodiments of the disclosed subject matter, a free end of the captivator 151 opposite the end connected to the connection extension 155, can define an opening to provide access to a tip of the conductor pin 152. A diameter of the opening can vary from widest at the free end to more narrow away from the free end, and may be generally constant or non-narrowing at some point at or around a tip portion of the conductor pin 152. Such narrowing of the diameter can allow for some degree of misalignment when mating another connector to the captivator 151, such that the connector is guided, in the case of misalignment, to alignment with the central axis and hence the conductor pin 152. The non-narrowing portion of the captivator 151 can frictionally hold the other connector in the captivator 151 such that the connector is electrically connected to the conductor pin 152. The narrowing of the recess of the captivator 151 can form an angle from opposing sides, for instance, at or about sixty degrees, which can accommodate a certain amount of radial misalignment for the incoming connector, for instance, +/− three degrees.

Each of the first and second connector assemblies 121, 131 can be configured to be arranged in an uncompressed state and a compressed state. Generally, the uncompressed state can be when a connector is not operatively connected to the first connector 122, 132, though the spring 158 may still be compressed to some degree, and the compressed state can be when a connector is operatively connected to the first connector 122, 132. FIG. 8, for instance, shows an example of the uncompressed state. More specifically, the captivator 151, the connection extension 155, the spring 158, and the conductor pin 152 can move along a longitudinal axis of the first or the second connector assembly 121, 131, toward or away from the second connector 126, 136.

According to one or more embodiments, the conductor pin 152 can be moved, by compression of the spring 158 by the captivator 151, in correspondence with movement of the captivator 151 and the connection extension 155, to engage the second connector 126, 136, particularly the terminal 165 thereof. The spring 158 may contribute to controlled movement of the conductor pin 152, for instance, by controlling an amount of force or velocity by which the conductor pin 152 can be moved to be seated in the terminal 165. Such controlled movement may prevent or minimize damage to the terminal 165 and corresponding end of the conductor pin 152 during engagement. In such configuration the conductor pin 152 can be properly seated in the terminal 165, and the connector assembly 121, 131 can be operatively coupled to pass a signal, such as an RF signal, between opposite ends thereof, via the conductor pin 152, the terminal 165, and the conductor pin 162. Movement to the compression state can be when a connector is operatively connected to the captivator 151 of the first connector 122, 132.

The retainer shroud 157 can be configured to slidably and retainably accommodate the connection extension 155. Optionally, the connection extension 155 can have a step feature to abut against the front wall of the connector block 100 (or the first and second connector arms 120, 130) and prevent further movement of the captivator 151 and hence the conductor pin 152 toward the second conductor 126, 136.

In the uncompressed state the first connector 122, 132 can be retained in the channel 150, such as shown in FIG. 8. Optionally, a locking configuration may be provided to retain or lock the first connector 122, 132 in the uncompressed state. For example, at least one ridge, tab, indent, or protrusion 156 can be provided on the connection extension 155, and at least one ridge, tab, indent, or protrusion 159 can be provided on the retainer shroud 157. Once the connection extension 155 is moved toward the second connector 126, 136 by a predetermined amount, the protrusions 156, 159 can engage to prevent movement of the connection extension 155 (and hence the conductor pin 152 and captivator 151) away from the second connector 126, 136, especially since the spring 158 may be in a loaded state even in the uncompressed state of the first or second connector assembly 121, 131. Optionally, in the uncompressed state, the end of the conductor pin 152 associated with the terminal 165 can reside at the entrance of the terminal 165, and not fully seated therein. In such state the conductor pin 152 and the conductor pin 162 may be in an electrically discontinuous state.

The following dimensions for the connector block and components thereof are merely examples according to one or more embodiments and are not intended to be limiting: a depth or length of the connection interface 161 can be less than 0.06 in., for instance, 0.05±0.005 in.; a length from the end of the connection interface 161 to the conductor pin shield 153 can be less than 0.55 in., for instance, 0.513±0.007 in.; a height or thickness of the connection interface 161 can be less than 0.06 in., for instance, 0.052 in.; a width of the connector block 100 can be less than 0.70 in, for instance, equal to 0.588±0.006 in.; a length of the connector block 100 can be less than 1.2 in., for instance, equal to 1.0045±0.005 in.; a distance between centers of the pins 116 and/or the through holes 118 can be less than 0.14 in, for instance, at or about 0.135 in.; a diameter of the pins 116 can be at or about 0.025 in.; a diameter of the through holes 118 can be at or about to 0.032 in.; a distance between centers of pin 116 and an associated through hole 118 can be less than 0.06 in., for instance, equal to 0.057±0.005 in.; a distance from a center of the pin 116 to a central longitudinal axis of an end-most connector assembly 131 of the second connector arm 130 can be less than 0.55 in., for instance, equal to 0.510 in. (and a distance from the center of the pin 116 to a central longitudinal axis of an end-most connector assembly 121 of the first connector arm 120 can be less); a width of the first connector arm 120 and/or the second connector arm 130 exclusive of the connection interface 161 can be less than 0.240 in, for instance, equal to 0.235±0.002 in.; a width of the first connector arm 120 and/or the second connector arm 130 can be less than 0.340 in, for instance, 0.335±0.002 in.; an inner radius of the connection interface 161 for operative connection to a corresponding connector can be less than 0.07 in, for instance, equal to 0.0630 in.; a distance between the inner radius of the connection interface 161 for operative connection and an outer surface of the connection interface 161 can be less than 0.02 in, for instance, equal to 0.016±0.006 in.; a distance between inner radii of the connection interface 161 for operative connection between adjacent second connectors 126, 136 can be less than 0.05 in, for instance, equal to 0.042 in.; a radius of curvature for an inner surface of the connection interface 161 for operative connection (in an end view of the second connector 126, 136) can be less than 0.07 in., for instance, equal to 0.0630 in.; an outer diameter of the captivator 151 can be less than 0.10 in, for instance, 0.094 in.±0.002 in.; a center-to-center distance between adjacent captivators 151 can be at or about 0.105 in.; and/or a center-to-center distance between an end-most captivator 151 of the second connector extension 130 to a closest captivator 151 of the first connector extension 120 can be 0.8055±0.001 in.

The Table below shows exemplary, non-limiting electrical, mechanical, and environmental data for connector block 100 and components thereof, according to embodiments of the disclosed subject matter. Such values are merely examples and not intended to necessarily limit embodiments of the disclosed subject matter.

TABLE

| ELECTRICAL DATA | |
|---|---|
| Impedance | 50 Ω |
| Frequency | DC to 26.5 GHz |
| Return Loss | ≥30 dB, DC to 20 GHz, ≥20 dB, 20-50 GHz |
| Insertion Loss | $\leq 0.06 \times \sqrt{f(\text{GHz})}$ dB, DC to 26.5 GHz |
| Insulation Resistance | ≥3.5 GHz |
| Center Contact Resistance | ≤6 m Ω |
| Outer Contact Resistance | ≤2 m Ω |
| Test Voltage (At Sea Level) | 250 V rms |
| RF High Potential (At Sea Level) | 105 V rms @ 5 MHz |
| MECHANICAL DATA | |
| Mating Cycles-Ultra Smooth Bore | ≥1000 |
| Engagement Force-Ultra Smooth Bore | 1 $lb_f$ [4.45 N] |
| Disengagement Force-Ultra Smooth Bore | 0.5 $lb_f$ [2.2 N] |
| Spring Force (Nominal Preload) | 1.15 $lb_f$ [5.12 N] |
| Spring Rate (Nominal) | 36 $lb_f$/in. [6.3 N/mm] |
| Maximum Spring Deflection | 0.040 in. [ 1.02 N/mm] |
| ENVIRONMENTAL DATA | |
| Temperature Range | −55 C. to +165 C. |
| Thermal Shock | MIL-STD-202-107, Condition B |
| Vibration | MIL-STD-202-204, Condition B |
| Shock | MIL-STD-202-213, Condition A |
| Moisture Resistance | MIL-STD-202-106 |
| 2002/95/EC (RoHS) | |

Figure 9:
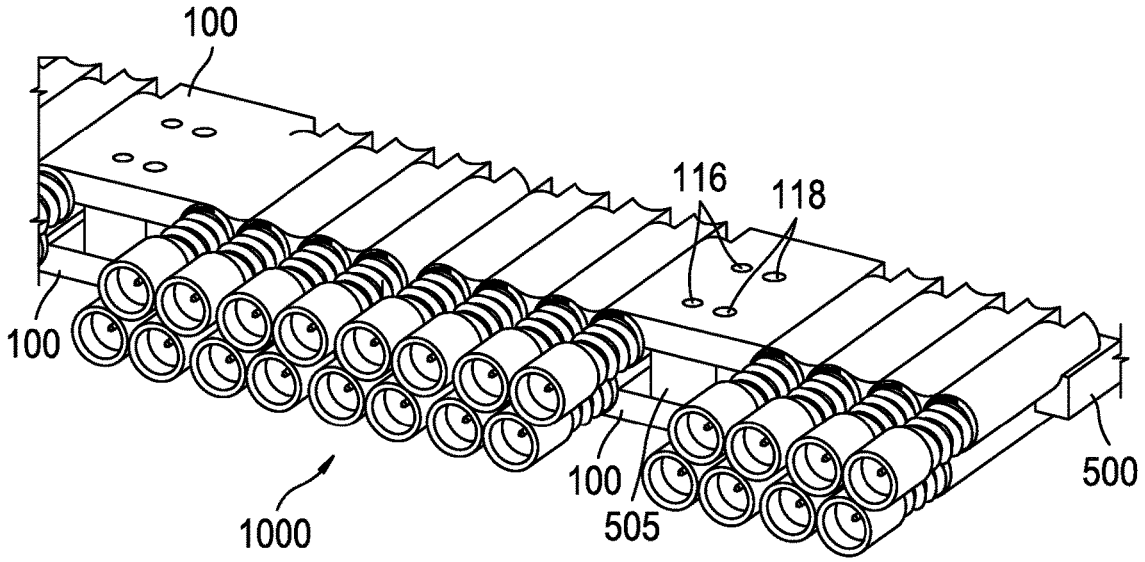
FIG. 9 is an overhead perspective view of a connection system according to embodiments of the disclosed subject matter.

Turning to FIG. 9, an overhead perspective view of a connection system 1000 is shown according to embodiments of the disclosed subject matter.

The connection system 1000 can have at least two connector blocks, such as connector blocks 100 discussed above for FIGS. 1-8. FIG. 9 shows four connector blocks 100, for instance. In another embodiment, eight connector blocks 100 may be provided, for a total of sixty-four connector assemblies 121, 131 (in a case of eight connector assemblies 121, 131 per connector block 100). Optionally, at least two or more or all of the connector blocks 100 may be identical.

In the connection system 1000, notably, connector blocks 100 can be arranged side-by-side, such as along side and top edge surfaces of a printed circuit board (PCB) 500. Additionally or alternatively, connector blocks 100 can be arranged according to a top-bottom configuration, a first connector block 100 being along side and top edges of the PCB 500 and a second connector block 100 being below the first connector block 100, along the side edge surface of the PCB 500 and a bottom edge surface of the PCB 500. In the top-bottom configuration the bottoms of the connector blocks 100 can face each other. As shown in FIG. 9, for instance, the connector blocks 100 in the top-bottom configuration, i.e., a top-bottom pair of connector blocks 100, can be offset in the lengthwise direction.

As shown in FIG. 9, a top connector block 100 of the top-bottom configuration can be coupled or mounted to a top surface of a spacer or mounting block 505 (in addition to being coupled to the side edge of the PCB 500 via second connectors 126, 136 in the form of an edge launch connector, in this example). The bottom connector block 100 of the top-bottom configuration can be coupled or mounted to a bottom surface of the mounting block 505, such as shown in FIG. 9. As can be seen, the bottom sides of the connector blocks 100 can face each other. Also shown in FIG. 9, the connector assemblies 121, 131 of the top connector block 100 can be offset from the connector assemblies 121, 131 of the bottom connector block 100. Thus, the connector assemblies 121, 131 of the bottom connector block 100 may not be directly below and in line (i.e., vertical line) with connector assemblies 121, 131 of the top connector block 100. For example, the connector blocks 100 can be offset from each other by an amount equal to one half the center-to-center spacing of the connector assemblies 121, 131 (in a front view of the connector blocks 100). According to one or more embodiments, the misalignment or offset of the top-bottom configuration can be based on the pins 116, particularly their offset nature when the bottom connector block 100 is rotated one-hundred and eighty degrees, which, as noted above can be used to align the connector block 100 on the mounting block 505. Such offset may be such that mutual inductance between connector assemblies 121, 131 between the two connector blocks 100 is the same, which can minimize interference.

Figure 10:
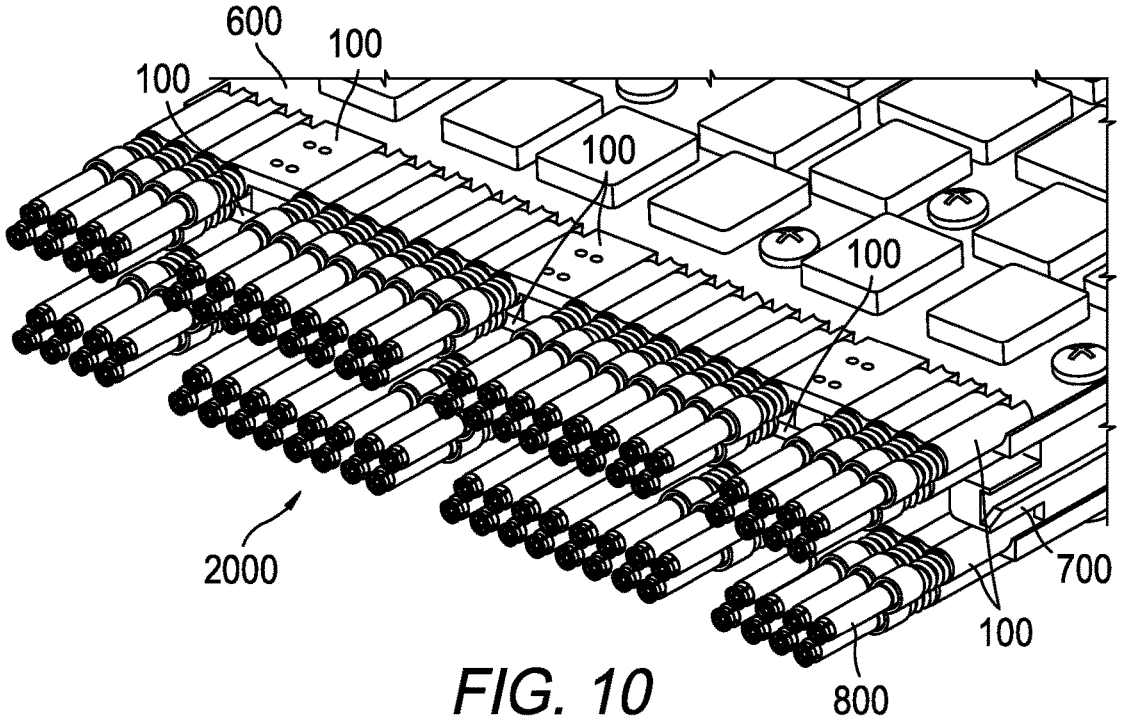
FIG. 10 is an overhead perspective view of a connection system according to embodiments of the disclosed subject matter.

FIG. 10 is an overhead perspective view of a connection system 2000 according to embodiments of the disclosed subject matter.

The connection system 2000 is similar to connection system 1000 discussed above, but expressly shows a configuration of twelve connector blocks 100, including two sets of top-bottom configured connector blocks 100. In particular, a first set of top-bottom connector blocks 100 can be operatively coupled to a first printed circuit board (PCB) 600, such as shown in FIG. 10 and similar to discussed above for connection system 1000. The second set of top-bottom connector blocks 100 can be operatively coupled to a second printed circuit board (PCB) 700 stacked below the first PCB 600. In that each of the connector blocks 100 can have four connector assemblies 121 and four connector assemblies 131 (i.e., eight total connector assemblies), the connection system 2000 can provide ninety-six connector assemblies (and hence first connectors 122, 132). FIG. 10 also shows that each of the first connectors 122, 132 can receive elongate connectors 800 in the form of bullet connectors having opposing female ends. In this example, the connector blocks 100, as a whole, can have dimensions within a three inch by ½ inch envelope.

Figure 11:
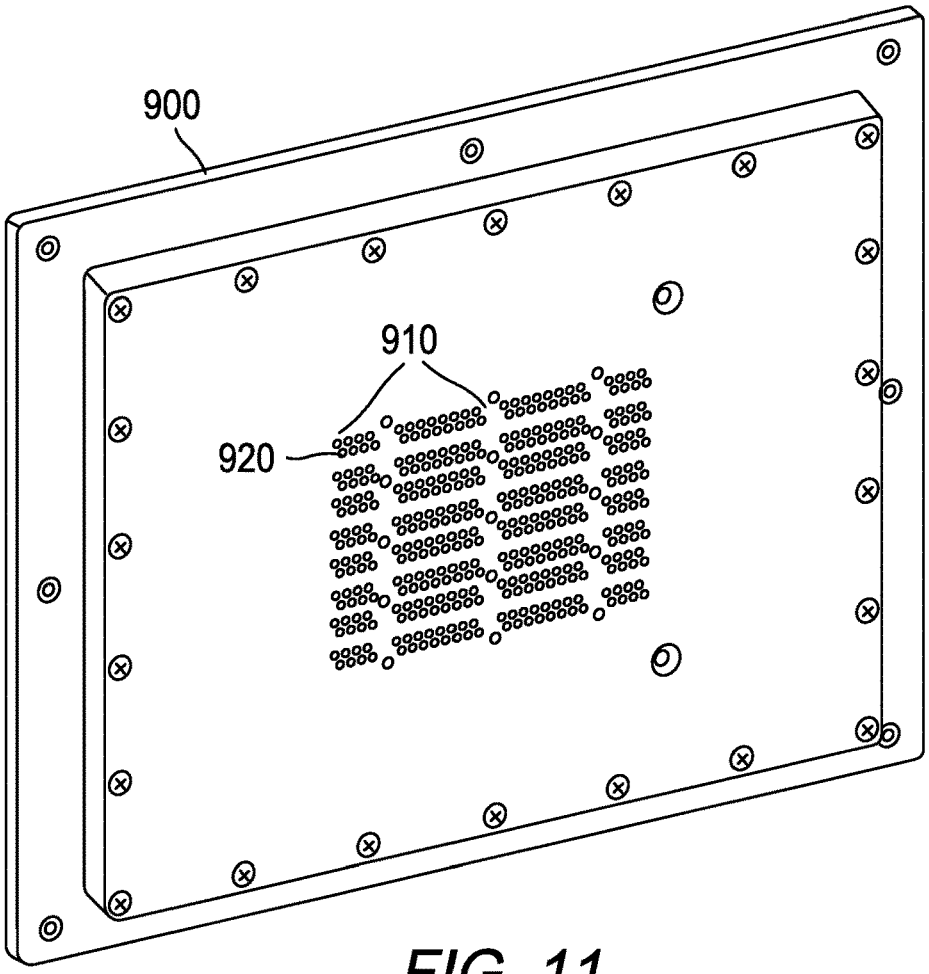
FIG. 11 is a perspective view of an aperture plate according to one or more embodiments of the disclosed subject matter.
Figure 12:
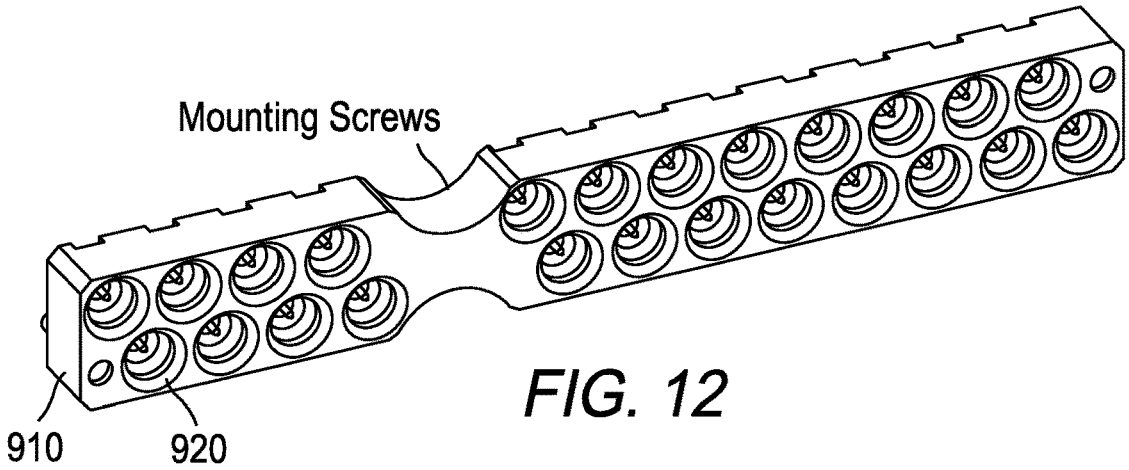
FIG. 12 is a connection segment for the aperture plate of FIG. 11.

FIGS. 11 and 12 show an aperture plate 900, a connection segment 910 of the aperture plate 900, and an individual connection interface 920 of the connection segment 910, for instance, a broadband electromagnetic aperture (e.g., a broadband synthetic-aperture radar (SAR)). Notably, aperture plate 900 can have eight rows of connection segments 910, and each row can have two connection segments 910 per row. Further, each row of connection segments 910 can have two rows of the individual connection interfaces 920, such as shown in FIG. 12.

Each of the individual connection interfaces 920, which may be a male connection interface, can be configured to receive a corresponding elongate connector 800, which, as noted above, can be connected to respective first connectors 122, 132 of connector blocks 100 according to embodiments of the disclosed subject matter. In this example, each row of connection segments 910 can accommodate forty-eight elongate connectors 800, which may correspond to six connector blocks 100 arranged in top-bottom configuration as discussed above, and such as shown in FIG. 10. In this example, two adjacent rows of connection segments 910 can have dimensions within a three inch by ½ inch envelope.

As noted above, embodiments of the disclosed subject matter can involve multiple connectors (e.g., RF connectors) adjoined as a single connector block 100 with one set of mounting accommodations. Such single connector block 100 may provide for a sharing of the structural load across the connectors, a sharing of alignment features, and/or a sharing of mounting features. Springs 158 may be embedded to provide a spring with a decreased diameter, which may prevent unnecessary tolerance buildup caused by the springs 158 and reduce diametric impact, which can lead to sufficient clearance to one or more neighboring connectors 122, 132 of the single connector block 100. Such configuration can provide suitable radial and axial misalignment between adjacent connector assemblies and components thereof, including between connectors 122, 132 and/or connectors 126, 136.

Embodiments of the disclosed subject matter can also allow for top-bottom arrangement of individual connector blocks 100. Embodiments of the disclosed subject matter, therefore, can provide connector blocks 100 on opposing sides of a single PCB, for instance.

Embodiments of the disclosed subject matter may also be as set forth according to the parentheticals in the following paragraphs.

(1) A spring embedded blind mate connector block comprising a first housing and a second housing, wherein each housing has a proximal edge, a distal edge parallel to the proximal edge, a first edge, a second edge parallel to the first edge and perpendicular to the proximal edge; a first center flange in the first housing; a second center flange in the second housing; a plurality of alignment pins in each center flange; a plurality of screw holes in each center flange; a first plurality of semi-cylindrical cavities extending outwardly from the first center flange towards the first edge, wherein each cavity of the first plurality of semi-cylindrical cavities is evenly spaced from each other cavity of the first plurality of semi-cylindrical cavities; a second plurality of semi-cylindrical cavities extending outwardly from the first center flange towards the second edge, wherein each cavity of the second plurality of semi-cylindrical cavities is evenly spaced from each other cavity of the second plurality of semi-cylindrical cavities; a third plurality of second semi-cylindrical cavities extending outwardly from the second center flange towards the first edge, wherein each cavity of the third plurality of semi-cylindrical cavities is evenly spaced from each other cavity of the third plurality of semi-cylindrical cavities; a fourth plurality of second semi-cylindrical cavities extending outwardly from the second center flange towards the right edge, wherein each cavity of the fourth plurality of semi-cylindrical cavities is evenly spaced from each other cavity of the fourth plurality of semi-cylindrical cavities, wherein the first plurality equals the third plurality and the second plurality equals the fourth, and wherein the sum of the first and second pluralities equals the sum of the third and fourth pluralities; a fifth plurality of spring embedded blind mate male to female connectors, wherein the fifth plurality equals the sum of the first and second pluralities, each spring embedded blind mate male to female connector including: a longitudinal body having a proximal end and a distal end, the body having a central axis from the proximal end to the distal end, and a central cavity, the body including: a captivator located at the proximal end; a main conductor pin; a conductor pin shield surrounding at least a first portion of the main conductor pin; an outer sheath connected axially to the conductor pin shield and surrounding a second portion of the main conductor pin; an inner sheath surrounding a third portion of the main conductor pin; a retainer shroud surrounding a portion of the outer sheath; a dielectric retainer surrounding at least a portion of the inner shield; a spring surrounding at least a portion of the outer sheath; wherein the captivator, main conductor pin, conductor pin shield, outer sheath, inner sheath, retainer shroud, dielectric retainer and spring are coaxially located with respect to the central axis; and wherein the first housing and the second housing are configured to form a plurality of cylindrical cavities when the alignment pins are mated, wherein each cylindrical cavity is configured to contain a spring embedded blind mate male to female connector.

(2) The spring embedded blind mate connector block according to (1), wherein the captivator has a diameter which varies from a first diameter at the proximal end and a second diameter at a rear end, wherein the first diameter is greater than the second diameter.

(3) The spring embedded blind mate connector block according to (1) or (2), wherein the conductor pin shield includes blades.

(4) The spring embedded blind mate connector block according to any one of (1) to (3), wherein the outer sheath has locking protrusions; wherein the outer pin shield includes retention features configured to lock behind the locking protrusions.

(5) The spring embedded blind mate connector block according to any one of (1) to (4), wherein the captivator and the spring are constructed of stainless steel.

(6) The spring embedded blind mate connector block according to any one of (1) to (5), wherein the main conductor pin, the outer sheath, the retainer shroud and the inner sheath are each constructed of beryllium copper; wherein the main conductor pin, the outer sheath, the retainer shroud and the inner sheath each have hollow cylindrical geometry with an inner surface; and wherein each inner surface is plated with an inner layer of nickel and an outer layer of gold.

(7) The spring embedded blind mate connector block according to any one of (1) to (6), wherein the conductor pin shield is constructed of polytetrafluoroethene.

(8) The spring embedded blind mate connector block according to any one of (1) to (7), wherein the first, second, third and fourth plurality of semi-cylindrical cavities equals four and wherein the fifth plurality of spring embedded blind mate male to female connectors equals eight.

(9) The spring embedded blind mate connector block according to any one of (1) to (8), wherein the main conductor pin includes internal wires constructed of beryllium copper, plated with a layer of gold over a layer of nickel.

(10) The spring embedded blind mate connector block according to any one of (1) to (9), wherein the dielectric retainer is constructed of polyamide-imide.

(11) The spring embedded blind mate connector block according to any one of (1) to (10), wherein the first, second, third and fourth semi-cylindrical cavities include a U-shaped cut-out at their distal ends, which form edge launch tines when the alignment pins are mated.

(12) The spring embedded blind mate connector block according to any one of (1) to (11), wherein the first diameter of each captivator is 0.094±0.002 inches.

(13) The spring embedded blind mate connector block according to any one of (1) to (12), wherein a spacing between a centerline of a first cylindrical cavity to a centerline of a second proximate cylindrical cavity is 0.105 inches.

(14) A layered connector construction comprising a plurality of spring embedded blind mate connector blocks according to any one of (1) to (13), further comprising: a first spring embedded blind mate connector block; a second spring embedded blind mate connector block, each connector block having a top side and a bottom side; a spacer; a first plurality of mounting screws; wherein the bottom side of the first spring embedded blind mate connector block is aligned proximate the bottom side of the second spring embedded blind mate connector block; wherein the spacer block is located between and aligned with the center flanges of the first and second spring embedded blind mate connector block; wherein a mounting screw is inserted through each screw hole into the spacer; and wherein the alignment of the bottom sides offsets the cylindrical cavities of the first spring embedded blind mate connector block with the cylindrical cavities of the second spring embedded blind mate connector block an amount equal to one-half the distance between proximate cylindrical cavities.

(15) An aperture plate configured to combine a plurality of layered connector constructions according to any one of (1) to (14), comprising: a plurality of male connection ports, each male connection port having at least two relief cuts, each relief cut configured to provide a space for insertion of a mounting screw; a second plurality of mounting screws; wherein a first set of male connection ports is configured to mate to a proximal edge of a first layered connector construction; wherein a second set of male connection ports is configured to mate to a proximal edge of a second layered connector construction; wherein each relief cut is configured to align with a central flange of the first layered connector construction; and wherein the plurality of male connection ports are installed in a matrix formation on the aperture plate by the mounting screws.

(16) The aperture plate according to any one of (1) to (15), wherein the plurality of male connection ports is twelve.

(17) The aperture plate according to any one of (1) to (16), wherein the plurality of male connection ports is sixteen.

(18) A spring embedded blind mate connector block assembly, comprising: a first housing and a second housing, each housing including a center flange and a plurality of semi-cylindrical cavities extending outwardly from either side of the center flange; a plurality of alignment pins and screw holes in each center flange; a plurality of spring embedded blind mate male to female connectors inserted in the semi-cylindrical cavities between the first housing and the second housing.

(19) The spring embedded blind mate connector block assembly according to (18), wherein each spring embedded blind mate male to female connector further comprises: a captivator located at a proximal end; a main conductor pin located between the captivator and a distal end; a conductor pin shield surrounding at least a first portion of the main conductor pin; an outer sheath connected axially to the conductor pin shield and surrounding a second portion of the main conductor pin; an inner sheath surrounding a third portion of the main conductor pin; a retainer shroud surrounding a portion of the outer sheath; a dielectric retainer surrounding at least a portion of the inner shield; a spring surrounding at least a portion of the outer sheath.

(20) The spring embedded blind mate connector block assembly according to any one of (18) to (19), further comprising: wherein the distal end of each semi-cylindrical cavity includes a U-shaped cut-out forming edge launch tines when the first housing is aligned to the second housing.

(21) A spring-embedded blind mate connector block for a radar system comprising: a mounting base having a bottom mounting surface configured to be mounted to an upper surface of a mounting structure associated with a printed circuit board (PCB); a first radio frequency (RF) connector arm integral with the mounting base and extending from the mounting base in a first direction, the first direction being in a length-wise direction of the spring-embedded blind mate connector block; and a second radio frequency (RF) connector arm integral with the mounting base and extending from the mounting base in a second direction opposite the first direction, the second direction being in the length-wise direction of the spring-embedded blind mate connector block, wherein the first RF connector arm includes a first set of RF connector assemblies, wherein the second RF connector arm includes a second set of RF connector assemblies, wherein the first and second sets of RF connector assemblies are aligned with each other in the length-wise direction of the spring-embedded blind mate connector block, wherein each of the RF connector assemblies includes: a first RF connector extending from a first side of the spring-embedded blind mate connector block, the first RF connector being a male-to-female RF connector, and a second RF connector at a second side of the spring-embedded blind mate connector block opposite the first side, the second RF connector being a male-to-PCB edge launch connector, wherein the first RF connector and the second RF connector are aligned with each other in a width-wise direction of the spring-embedded blind mate connector block, and wherein each of the first RF connectors includes a captivator, a connection extension having a first end coupled to the captivator and a second end provided in a channel formed inside the spring-embedded blind mate connector block, and a spring circumscribing the connection extension and embedded between the captivator and the first side of the spring-embedded blind mate connector block, the spring being in abutting relationship with the captivator and the first side of the spring-embedded blind mate connector block and having a diameter no greater than a diameter of the captivator.

(22) The spring-embedded blind mate connector block according to (21), wherein each said set of the first and second sets of RF connector assemblies is comprised of at least four RF connector assemblies.

(23) The spring-embedded blind mate connector block according to (21) or (22), wherein each said set of the first and second sets of RF connector assemblies consists of four RF connector assemblies.

(24) The spring-embedded blind mate connector block according to any one of (21) to (23), wherein for each of the first RF connectors, the captivator, the connection extension, and the spring are operably movable along a longitudinal axis of the RF connector assembly.

(25) The spring-embedded blind mate connector block according to any one of (21) to (24), wherein the movement of the captivator, the connection extension, and the spring along the longitudinal axis causes a conductor pin of the first RF connector to engage or disengage a terminal of the second RF connector.

(26) The spring-embedded blind mate connector block according to any one of (21) to (25), wherein the mounting base has a pair of dual-purpose mounting and alignment pins extending from the bottom mounting surface.

(27) The spring-embedded blind mate connector block according to any one of (21) to (26), wherein the first RF connector as the male-to-female RF connector is a nano-miniature male-to-female RF connector.

(28) The spring-embedded blind mate connector block according to any one of (21) to (27), wherein a top surface of the mounting base opposite the bottom mounting surface forms an uppermost portion of the spring-embedded blind mate connector block, and the bottom mounting surface is at a height above bottom-most portions of the first RF connector arm and bottom-most portions of the second RF connector arm.

(29) A blind mate connection system comprising: a first blind mate connector block configured to interface with an upper surface of a printed circuit board (PCB); and a second blind mate connector block configured to interface with a lower surface of the PCB opposite the upper surface of the PCB, wherein respective bottoms of the first and second blind mate connector blocks face each other when the first and second blind mate connector blocks interface with the upper and lower surfaces of the PCB, respectively, and wherein each of the first and second blind mate connector blocks includes: a mounting base, a first connector arm extending from the mounting base in a first direction, the first direction being in a length-wise direction of the blind mate connector block, and a second connector arm extending from the mounting base in a second direction opposite the first direction, the second direction being in the length-wise direction of the blind mate connector block, wherein the first connector arm includes a first set of connector assemblies, wherein the second connector arm includes a second set of connector assemblies, and wherein the first and second sets of connector assemblies are aligned with each other in the length-wise direction of the blind mate connector block.

(30) The blind mate connection system according to (29), wherein when the respective bottoms of the first and second blind mate connector blocks face each other, the first set of connector assemblies of the first blind mate connector block overlap but are misaligned with the second set of connector assemblies of the second blind mate connector block, and the second set of connector assemblies of the first blind mate connector block overlap but are misaligned with the first set of connector assemblies of the second blind mate connector block.

(31) The blind mate connection system according to (29) or (30), wherein when the respective bottoms of the first and second blind mate connector blocks face each other, the first blind mate connector block is offset from the second blind mate connector block in the length-wise direction based on a pair of alignment and shear pins extending from the mounting base of each of the first and second blind mate connector blocks.

(32) The blind mate connection system according to any one of (29) to (31), wherein the first and second blind mate connector blocks are identical.

(33) The blind mate connection system according to any one of (29) to (32), wherein each of the connector assemblies includes a pair of opposing, axially-aligned connectors, a first connector of the pair of connectors having a captivator, a connection extension, and a spring circumscribing the connection extension and embedded between the captivator and a closest side of the blind mate connector block, and wherein the spring is in abutting relationship with the captivator and the closest side of the blind mate connector block and has an outer diameter no greater than an outer diameter of the captivator.

(34) The blind mate connection system according to any one of (29) to (33), wherein the first and second sets of connector assemblies of the first blind mate connector block are aligned with each other in the length-wise direction of the first blind mate connector block, and wherein the first and second sets of connector assemblies of the second blind mate connector block are aligned with each other in the length-wise direction of the second blind mate connector block.

(35) A spring-embedded blind mate connector assembly comprising: a first connector extending in a first direction; and a second connector extending in a second direction opposite the first direction, wherein the first connector and the second connector have a common axis, wherein the first connector and the second connector are operatively coupled to pass a signal between opposite ends of the spring-embedded blind mate connector assembly, wherein the first connector includes: a captivator, a connection extension, and a spring between the captivator and the second connector, the spring abutting the captivator and having an outer diameter no greater than an outer diameter of the captivator.

(36) The spring-embedded blind mate connector assembly according to (35), further comprising a housing configured to house respective portions of the first connector and the second connector, including a portion of the connection extension of the first connector, wherein the spring abuts a surface of the housing that faces the captivator.

(37) The spring-embedded blind mate connector assembly according to (35) or (36), wherein the housing is part of a blind mate connector block comprised of a plurality of said spring-embedded blind mate connector assemblies.

(38) The spring-embedded blind mate connector assembly according to any one of (35) to (37), wherein the first connector is a nano-miniature male-to-female RF connector.

(39) The spring-embedded blind mate connector assembly according to any one of (35) to (38), wherein the captivator, the connection extension, and the spring are movable along the common axis between an uncompressed state and a compressed state of the first connector.

(40) The spring-embedded blind mate connector assembly according to any one of (35) to (39), wherein the movement of the captivator, the connection extension, and the spring along the common axis causes a conductor pin of the first connector to engage or disengage a terminal of the second connector.

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can be and are also employed.

Further, numerous modifications and other embodiments (e.g., combinations, rearrangements, etc.) are enabled by the present disclosure and are contemplated as falling within the scope of the disclosed subject matter and any equivalents thereto. Features of the disclosed embodiments can be combined, rearranged, omitted, etc., within the scope of described subject matter to produce additional embodiments. Furthermore, certain features may sometimes be used to advantage without a corresponding use of other features.

Accordingly, Applicant intends to embrace all such alternatives, modifications, equivalents, and variations that are within the spirit and scope of the present disclosure. Further, it is therefore to be understood that within the scope of the appended claims, the disclosure may be practiced otherwise than as specifically described herein.

The invention claimed is:

1. A spring-embedded blind mate connector block for a radar system comprising:

a mounting base having a bottom mounting surface configured to be mounted to an upper surface of a mounting structure associated with a printed circuit board (PCB);

a first radio frequency (RF) connector arm integral with the mounting base and extending from the mounting base in a first direction, the first direction being in a length-wise direction of the spring-embedded blind mate connector block; and a second radio frequency (RF) connector arm integral with the mounting base and extending from the mounting base in a second direction opposite the first direction, the second direction being in the length-wise direction of the spring-embedded blind mate connector block, wherein the first RF connector arm includes a first set of RF connector assemblies, wherein the second RF connector arm includes a second set of RF connector assemblies, wherein the first and second sets of RF connector assemblies are aligned with each other in the length-wise direction of the spring-embedded blind mate connector block, wherein each of the RF connector assemblies includes:

a first RF connector extending from a first side of the spring-embedded blind mate connector block, the first RF connector being a male-to-female RF connector, and a second RF connector at a second side of the spring-embedded blind mate connector block opposite the first side, the second RF connector being a male-to-PCB edge launch connector, wherein the first RF connector and the second RF connector are aligned with each other in a width-wise direction of the spring-embedded blind mate connector block, and wherein each of the first RF connectors includes a captivator, a connection extension having a first end coupled to the captivator and a second end provided in a channel formed inside the spring-embedded blind mate connector block, and a spring circumscribing the connection extension and embedded between the captivator and the first side of the spring-embedded blind mate connector block, the spring being in abutting relationship with the captivator and the first side of the spring-embedded blind mate connector block and having a diameter no greater than a diameter of the captivator.

2. The spring-embedded blind mate connector block according to claim 1, wherein each said set of the first and second sets of RF connector assemblies is comprised of at least four RF connector assemblies.

3. The spring-embedded blind mate connector block according to claim 1, wherein each said set of the first and second sets of RF connector assemblies consists of four RF connector assemblies.

4. The spring-embedded blind mate connector block according to claim 1, wherein for each of the first RF connectors, the captivator, the connection extension, and the spring are operably movable along a longitudinal axis of the RF connector assembly.

5. The spring-embedded blind mate connector block according to claim 4, wherein the movement of the captivator, the connection extension, and the spring along the longitudinal axis causes a conductor pin of the first RF connector to engage or disengage a terminal of the second RF connector.

6. The spring-embedded blind mate connector block according to claim 1, wherein the mounting base has a pair of dual-purpose mounting and alignment pins extending from the bottom mounting surface.

7. The spring-embedded blind mate connector block according to claim 1, wherein a top surface of the mounting base opposite the bottom mounting surface forms an uppermost portion of the spring-embedded blind mate connector block, and the bottom mounting surface is at a height above bottom-most portions of the first RF connector arm and bottom-most portions of the second RF connector arm.

8. A blind mate connection system comprising:

a first blind mate connector block configured to interface with an upper surface of a printed circuit board (PCB); and a second blind mate connector block configured to interface with a lower surface of the PCB opposite the upper surface of the PCB, wherein respective bottoms of the first and second blind mate connector blocks face each other when the first and second blind mate connector blocks interface with the upper and lower surfaces of the PCB, respectively, and wherein each of the first and second blind mate connector blocks includes:

a mounting base, a first connector arm extending from the mounting base in a first direction, the first direction being in a length-wise direction of the blind mate connector block, and a second connector arm extending from the mounting base in a second direction opposite the first direction, the second direction being in the length-wise direction of the blind mate connector block, wherein the first connector arm includes a first set of connector assemblies, wherein the second connector arm includes a second set of connector assemblies, and wherein the first and second sets of connector assemblies are aligned with each other in the length-wise direction of the blind mate connector block.

9. The blind mate connection system according to claim 8, wherein when the respective bottoms of the first and second blind mate connector blocks face each other, the first set of connector assemblies of the first blind mate connector block overlap but are misaligned with the second set of connector assemblies of the second blind mate connector block, and the second set of connector assemblies of the first blind mate connector block overlap but are misaligned with the first set of connector assemblies of the second blind mate connector block.

10. The blind mate connection system according to claim 8, wherein when the respective bottoms of the first and second blind mate connector blocks face each other, the first blind mate connector block is offset from the second blind mate connector block in the length-wise direction based on a pair of alignment and shear pins extending from the mounting base of each of the first and second blind mate connector blocks.

11. The blind mate connection system according to claim 8, wherein the first and second blind mate connector blocks are identical.

12. The blind mate connection system according to claim 8, wherein each of the connector assemblies includes a pair of opposing, axially-aligned connectors, a first connector of the pair of connectors having a captivator, a connection extension, and a spring circumscribing the connection extension and embedded between the captivator and a closest side of the blind mate connector block, and wherein the spring is in abutting relationship with the captivator and the closest side of the blind mate connector block and has an outer diameter no greater than an outer diameter of the captivator.

13. The blind mate connection system according to claim 8, wherein the first and second sets of connector assemblies of the first blind mate connector block are aligned with each other in the length-wise direction of the first blind mate connector block, and wherein the first and second sets of connector assemblies of the second blind mate connector block are aligned with each other in the length-wise direction of the second blind mate connector block.

14. A spring-embedded blind mate connector assembly comprising:

a first connector extending in a first direction; and a second connector extending in a second direction opposite the first direction, wherein the first connector and the second connector have a common axis, wherein the first connector and the second connector are operatively coupled to pass a signal between opposite ends of the spring-embedded blind mate connector assembly, wherein the first connector includes:

a captivator, a connection extension, and a spring between the captivator and the second connector, the spring abutting the captivator and having an outer diameter no greater than an outer diameter of the captivator, and wherein the second connector further includes a channel and a retainer shroud provided within the channel, the retainer shroud being configured to slidably and retainably accommodate the connection extension, and wherein the movement of the captivator, the connection extension, and the spring along the common axis causes a protrusion of the connection extension to engage or disengage a protrusion of the retainer shroud.

15. The spring-embedded blind mate connector assembly according to claim 14, further comprising a housing configured to house respective portions of the first connector and the second connector, including a portion of the connection extension of the first connector, wherein the spring abuts a surface of the housing that faces the captivator.

16. The spring-embedded blind mate connector assembly according to claim 15, wherein the housing is part of a blind mate connector block comprised of a plurality of said spring-embedded blind mate connector assemblies.

17. The spring-embedded blind mate connector assembly according to claim 14, wherein the captivator, the connection extension, and the spring are movable along the common axis between an uncompressed state and a compressed state of the first connector.

18. The spring-embedded blind mate connector assembly according to claim 17, wherein the movement of the captivator, the connection extension, and the spring along the common axis causes a conductor pin of the first connector to engage or disengage a terminal of the second connector.

* * * * *